US009382783B2

(12) United States Patent
Langford et al.

(10) Patent No.: US 9,382,783 B2
(45) Date of Patent: Jul. 5, 2016

(54) ALIGNMENT SYSTEM FOR PERFORATING GUN

(71) Applicant: Hunting Titan, Inc., Pampa, TX (US)

(72) Inventors: Dale Langford, Pampa, TX (US); Ian Douglas Rudnik, Vassar, MI (US)

(73) Assignee: Hunting Titan, Inc., Pampa, TX (US)

( * ) Notice: Subject to any disclaimer, the term of this patent is extended or adjusted under 35 U.S.C. 154(b) by 0 days.

(21) Appl. No.: 14/286,587

(22) Filed: May 23, 2014

(65) Prior Publication Data

US 2015/0337635 A1 Nov. 26, 2015

(51) Int. Cl.
*E21B 43/116* (2006.01)
*E21B 43/117* (2006.01)

(52) U.S. Cl.
CPC ..... *E21B 43/116* (2013.01); *E21B 43/117* (2013.01); *Y10T 24/44* (2015.01)

(58) Field of Classification Search
CPC ..... E21B 43/116; E21B 43/117; E21B 43/11; E21B 43/118; E21B 43/119
USPC ..... 89/1.15, 1.151; 102/313; 166/55, 55.1, 166/63; 175/4.6
See application file for complete search history.

(56) References Cited

U.S. PATENT DOCUMENTS

| | | | | |
|---|---|---|---|---|
| 2,426,219 | A | 8/1947 | Jackson | |
| 2,749,162 | A | 6/1956 | Humphrey | |
| 2,813,732 | A | 11/1957 | Hird | |
| 4,583,602 | A * | 4/1986 | Ayers | 175/4.52 |
| 4,753,301 | A * | 6/1988 | Berry | 175/4.6 |
| 6,352,439 | B1 * | 3/2002 | Stark et al. | 439/142 |
| 6,851,471 | B2 * | 2/2005 | Barlow et al. | 166/55.2 |
| 7,000,699 | B2 * | 2/2006 | Yang et al. | 166/255.2 |
| 7,568,567 | B2 | 8/2009 | Chen et al. | |
| 7,762,351 | B2 * | 7/2010 | Vidal | 175/4.6 |
| 7,931,001 | B2 | 4/2011 | Bugescu et al. | |

* cited by examiner

*Primary Examiner* — Joshua Freeman
(74) *Attorney, Agent, or Firm* — Jason Saunders; Arnold, Knobloch & Saunders, L.L.P.

(57) ABSTRACT

An apparatus for restraining the movement of a gun charge holder within a gun tube including a snap ring with an alignment end that engages an end fitting and the gun tube simultaneously, the snap ring further comprising a grounding hole to facilitate the grounding of the electronics and detonation devices within the gun charge holder.

8 Claims, 2 Drawing Sheets

ALIGNMENT SYSTEM FOR PERFORATING GUN

FIELD

The invention generally relates to perforating guns used in a subterranean environment. More particularly, the invention relates using an alignment ring to accurately control the orientation of the explosive charges with respect to the perforating gun body.

BACKGROUND

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically a wellbore will be drilled from a surface location, placing a hole into a formation of interest. Completion equipment will be put into place, including casing, tubing, and other downhole equipment as needed. Perforating the casing and the formation with a perforating gun is a well known method in the art for accessing hydrocarbon deposits within a formation from a wellbore.

Explosively perforating the formation using a shaped charge is a widely known method for completing an oil well. A shaped charge is a term of art for a device that when detonated generates a focused explosive output. This is achieved in part by the geometry of the explosive in conjunction with a liner in the explosive material. Generally, a shaped charge includes a metal case that contains an explosive material with a concave shape, which has a thin metal liner on the inner surface. Many materials are used for the liner, some of the more common metals include brass, copper, tungsen, and lead. When the explosive detonates the liner metal is compressed into a super-heated, super pressurized jet that can penetrate metal, concrete, and rock.

A perforating gun has a gun body. The gun body typically is composed of metal and is cylindrical in shape. The gun body will have one or more scallops machined out of its surface. A scallop is a thin spot on the gun body, usually circular in shape. Each scallop is designed to align with a corresponding shape charge contained within the gun body. The scallop allows for a uniform thickness of metal that is at a ninety degree angle with respect to the plasma jet that exits an exploding shape charge. The scallop allows for less explosive energy needed to exit the gun body and for a more predictable trajectory of the plasma jet into the formation being perforated. Moreover, the scallops reduce the impact burrs created during detonation that may interfere with moving the gun or retrieving the gun. However, since the shape charges are typically located on a separate charge holder located within the gun body, it is difficult to perfectly align each scallop with its corresponding shape charge.

Within a typical gun tube is a charge holder, which is a tube that is designed to hold the actual shape charges. The charge holder will contain cutouts called charge holes where the shape charges will be placed. The alignment of the charge holder with the gun tube is important in controlling the position of the shape charges when they detonate. Error in the orientation of the shape charge with respect to the scallop can cause the explosive jet to miss its intended target within the formation.

A charge tube may have end fittings attached at either end. The end fittings provide for restricting the movement of the charge tube with respect to the gun body. The current method for aligning the charge holder with the gun tube involves using an alignment end with a slot and bolt design on the gun tube. The alignment end contains a bolt head or some other protrusion. The bolt is lined up with the first shape charge. The charge holder with the alignment end is then placed inside the gun body. The gun body has a slot cut out of the inner surface. The slot is aligned with the first scallop on the gun barrel, which also happens to be the closest scallop to the alignment end. The bolt on the alignment end will normally interfere with the threads or the inner surface of the gun body if there is no slot. Thereby preventing the charge holder from being placed in the gun body. However, the slot cut will allow the charge holder to be placed into the gun body so long as the bolt head is properly aligned with the slot cut. The slot cut on the gun body is aligned with the first scallop on the outside of the gun body.

This slot and bolt design is robust and simple in its execution. The problem with this design is that the slot has to be machined through the threads. Moreover, the length of the slot cut is limited by the machining capabilities as the slot cannot be milled into the inner gun body for more than a few inches from the end of the gun body. The bolt cannot be on the bottom of the gun charge because then the gun charge cannot be dropped into the gun tube from the top. This would require a slot machined into the side of the gun tube for the entire length of the gun tube, which is difficult and impractical. Therefore, this method cannot be used to align both ends of the charge holder with the gun tube. In some cases, such as with long perforating guns, the charges distant from the alignment end can drift out of alignment with the scallops, thereby reducing charge efficiency. Further, this method has certain manufacturing and installation limitations.

SUMMARY OF INVENTION

In a least one example of the invention, a perforating gun comprises a gun body having a bore, at least one scallop, a retaining ring groove, and a gun body alignment slot, a charge holder having at least one charge hole and a charge holder alignment slot, and a retaining ring having an alignment tab wherein the retaining ring is captured in the retaining ring groove and prevents the charge holder from translating in the bore in at least one direction and the alignment tab engages with the gun body alignment slot and the charge holder alignment slot to prevent rotation of the charge holder within the bore. One aspect to this example may include that the perforating gun has at least one scallop in the gun body wherein the engagement of the alignment tab with the gun body alignment slot and charge holder alignment slot aligns the at least one charge hole with the at least one scallop.

In variation of an example of the invention, the perforating gun further comprises a plurality of charge holes in the charge holder, and a plurality of scallops in the gun body, wherein the engagement of the alignment tab with the gun body alignment slot and charge holder alignment slot aligns the charge holes with the scallops.

In another variation of an example of the invention the perforating gun the retaining ring has a semicircular body and alignment tab is substantially orthogonal to the semicircular body. The perforating gun further comprises a grounding hole in the retaining ring.

In another example of the invention a perforating gun comprises a gun body having a bore, at least one scallop, a first retaining ring groove, a second retaining ring groove, a first gun body alignment slot, and a second gun body alignment slot, a charge holder having at least one charge hole, a first charge holder alignment slot near a first end, and a second charge holder alignment slot near a second end, a first retaining ring having an alignment tab, and a second retaining ring having an alignment tab, wherein the first retaining ring is captured in the retaining ring groove and prevents the charge holder from translating in the bore in at least one direction and the alignment tab engages with the gun body alignment slot and the charge holder alignment slot to prevent rotation of the charge holder within the bore.

In a variation of an example of the invention the perforating gun of further comprises at least one scallop in the gun body wherein the engagement of the alignment tabs with the gun body alignment slots and charge holder alignment slots aligns the at least one charge hole with the at least one scallop.

In another variation of an example of the invention the perforating gun further comprises a plurality of charge holes in the charge holder, a plurality of scallops in the gun body, wherein the engagement of the alignment tabs with the gun body alignment slots and charge holder alignment slots aligns the charge holes with the scallops. Furthermore, the perforating gun of has the retaining rings having a semicircular body and the alignment tab that is substantially orthogonal to the semicircular body. In another variation of an example of the invention the perforating gun further comprises a grounding hole in the retaining rings.

Another example of the invention is a retaining ring comprising a semicircular body, and an alignment tab, wherein the alignment tab is substantially orthogonal to the semicircular body. A variation of the retaining ring is that the retaining ring further comprises a grounding hole.

BRIEF DESCRIPTION OF THE DRAWINGS

For a thorough understating of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF THE DRAWINGS

In the following description, certain terms have been used for brevity, clarity, and examples. No unnecessary limitations are to be implied therefrom and such terms are used for descriptive purposes only and are intended to be broadly construed. The different systems and method steps described herein may be used alone or in combination with other systems and method steps. It is to be expected that various equivalents, alternatives, and modifications are possible within the scope of the appended claims.

Figure 1:
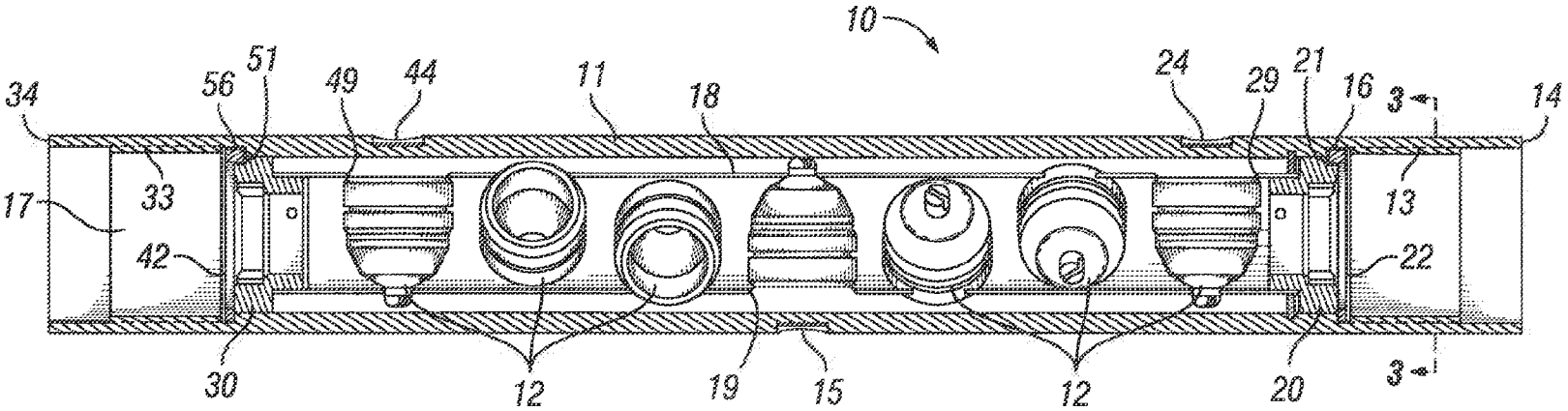
FIG. 1 is a side view of a fully assembled perforating gun.

As shown in FIG. 1, a typical perforating gun 10 comprises a gun body 11 that acts as a housing for all of the components necessary for containing the shape charge 12. The gun body 11 is a term of art that usually describes a cylindrical shaped tube, composed of a metal that is well known in the art. The gun body has threads 13, 33 on either end 14, 34, respectfully, that are used to assist in connecting the gun body to other tubulars, including multiple gun bodies, for use downhole. In the present embodiment these threads 13, 33 are internal. The gun body has one or more scallops 15 that are typically machined into the outside diameter of the gun body 11. A scallop 15 should align with a corresponding shape charge 12 located within the gun body 11. The scallop 15 allows the shape charge 12 to more easily penetrate the gun body 11 and facilitates a more uniform explosive jet. The scallop 15 reduces the external burrs created as the perforating jet exits the gun body 11, allowing for easier retrieval of the perforating gun 10. In this embodiment the gun body 11 has at least one gun body alignment slot 16.

The gun body alignment slot 16 may be formed by a variety of manufacturing and machining methods. The gun body alignment slot 16 may be formed by broaching a slot within the inner wall 17 of the gun body 11. The gun body alignment slot 16 may also be formed by electric discharge machining within the inner wall 17 of the gun body 11. The gun body alignment slot 16 may be formed by a combination of there or other machining operations or techniques that are known in the art.

The shape charges 12 are placed inside a charge holder 18 that contains at least one charge hole 19. Each charge hole 19, the corresponding shaped charge 12, and the corresponding scallop 15 on the gun body 11 need to all be substantially aligned in order to accurately place the holes being shot into the subterranean formation.

Figure 4:
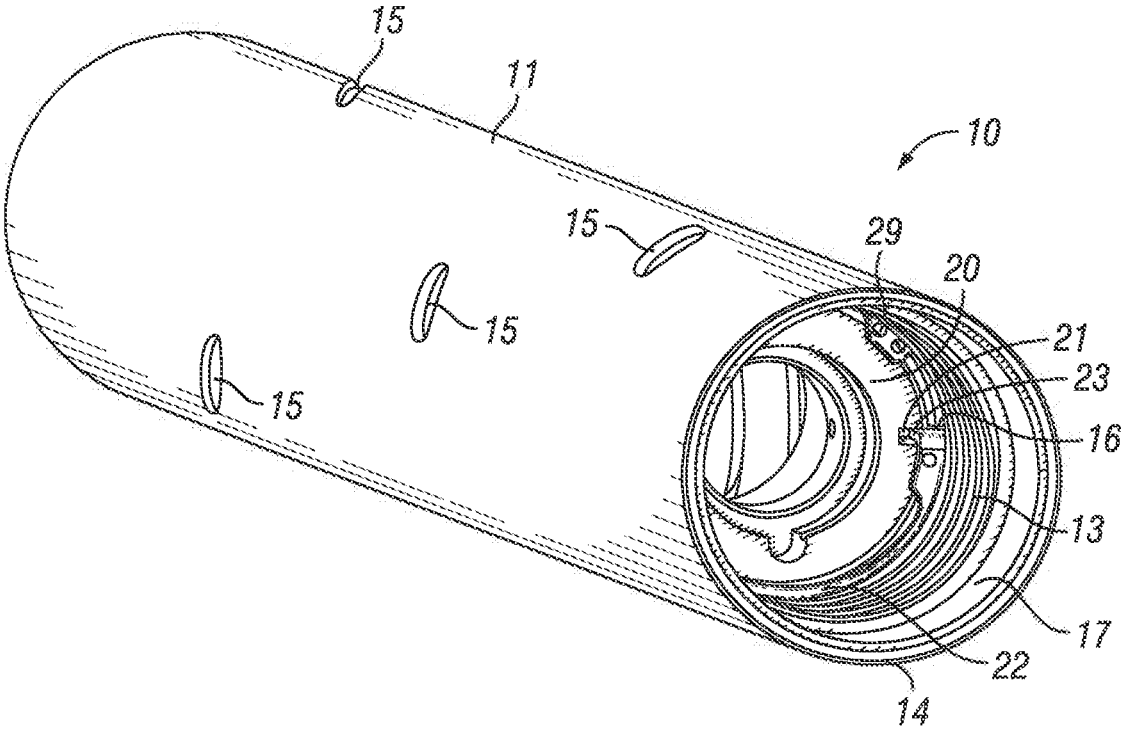
FIG. 4 is an oblique view of the fully assembled perorating gun with the snap ring installed.

The charge holder 18 is connected to the gun body 11 via at least one end fitting 20, 30. The end fitting 20 and the charge holder 18 are aligned with respect to each other via means that are well known in the art. The end fitting 20 contains the means for aligning the charge holder 18 and gun body 11. As shown in FIG. 4, the charge holder 18 end fitting 20 contains a slot 21 adapted to fit a snap ring 22. The snap ring 22 prevents longitudinal movement of the charge holder 18 in the gun body 11. The first charge hole is aligned with the first scallop such that they are aligned radially.

The end fitting 20 is connected to the charge holder 18. The end fitting 20 is aligned such that the slot 16 on the end fitting 20 is aligned with the first or nearest shape charge hole 29 on the charge holder 18. The end fitting 20 is held in alignment with the charge holder 18 via a fastening means that may include a screw, a bolt, or other means that are well known in the art.

Figure 2B:
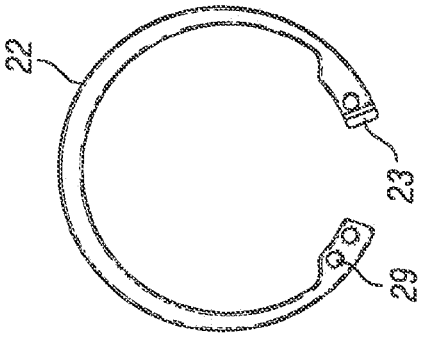
FIGS. 2*a* and 2*b* are views of the snap ring.
Figure 2A:
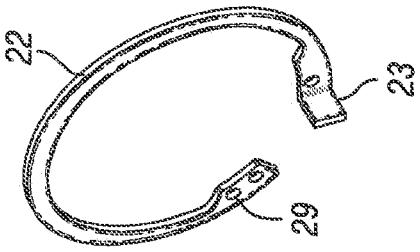
Figure 3:
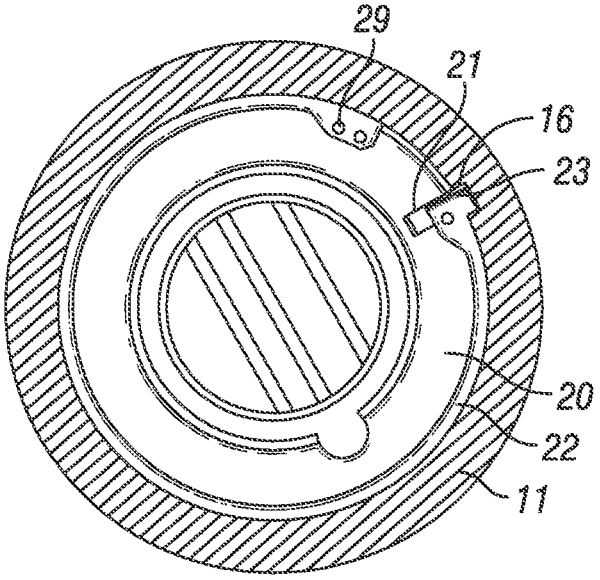
FIG. 3 is a cross sectional view of the end fitting with snap ring, installed in a gun tube.

A snap ring 22 with an alignment tab 23, as shown in FIGS. 2A and 2B, is used to align the end fitting with respect to the gun body. As shown in FIG. 3 and FIG. 4, the snap ring 22 interfaces with the end fitting alignment slot 21 and matches it to the gun body alignment slot 16. The alignment tab 23 on the snap 22 ring locks in the alignment of the end fitting 20 with the first scallop 44 on the gun body 11. The snap ring 22 has a grounding hole 29 that allows for an electrical ground within perforating gun 10. This electrical ground can be used to ground electronics to the gun body 11 and the attached tool string.

In another embodiment as depicted in FIG. 1, the charge holder 18 has an end fitting 20, 30 at both ends. Each end fitting 20, 30 has an end fitting holder alignment slot 21, 51. In this embodiment, there are two retaining rings 22, 42 that are used to align the charge tube 18 within the gun body 11 at both ends. In this embodiment, the additional retaining ring 42 provides a higher degree of accurate alignment between the one or more scallops 15 of the gun body 11 and the one or more corresponding charge holes 19 on the charge holder 18. As a result, the shape charges 12 located at each charge hole 19 are more closely aligned with each corresponding scallop 15. In this embodiment, as shown in FIG. 1, the far right scallop 24 is aligned with the first gun body alignment slot 16. The far right charge hole 29 is aligned with the end fitting alignment slot 21. Furthermore, the far left scallop 44 is aligned with the second gun body alignment slot 56. The far left charge hole 49 is aligned with the second end fitting alignment slot 51.

Although the invention has been described in terms of particular embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention. In particular, use of the terms "scallop", "retaining ring groove", "charge hole", "charge holder alignment slot", "retaining ring", "alignment tab", and "gun body alignment slot" herein and within the claims to follow are defined expansively to encompass equivalent terms that are well known in the art.

The invention claimed is:

1. A perforating gun comprising:

a gun body having a bore substantially aligned with a longitudinal axis of the gun body, at least one scallop, a circumferential retaining ring groove, and a gun body alignment slot substantially parallel to the longitudinal axis of the gun body;

a charge holder having at least one charge hole and a charge holder alignment slot substantially parallel to the longitudinal axis of the gun body; and a retaining ring having a semicircular body about the longitudinal axis of the gun body and an alignment tab substantially parallel to the longitudinal axis of the gun body;

wherein the body of the retaining ring is captured in the retaining ring groove and prevents the charge holder from translating in the bore in at least one direction and the alignment tab engages with the gun body alignment slot and the charge holder alignment slot to prevent rotation of the charge holder within the bore.

2. The perforating gun of claim 1 wherein the engagement of the alignment tab with the gun body alignment slot and charge holder alignment slot aligns the at least one charge hole with the at least one scallop.

3. The perforating gun of claim 1 further comprising:

a plurality of charge holes in the charge holder;

a plurality of scallops in the gun body;

wherein the engagement of the alignment tab with the gun body alignment slot and charge holder alignment slot aligns the charge holes with the scallops.

4. The perforating gun of claim 1 further comprising a grounding hole in the retaining ring.

5. A perforating gun comprising:

a gun body having a bore substantially aligned with a longitudinal axis of the gun body, at least one scallop, a first circumferential retaining ring groove, a second circumferential retaining ring groove, a first gun body alignment slot substantially parallel to the longitudinal axis of the gun body, and a second gun body alignment slot substantially parallel to the longitudinal axis of the gun body;

a charge holder having at least one charge hole, a first charge holder alignment slot near a first end substantially parallel to the longitudinal axis of the gun body, and a second charge holder alignment slot near a second end substantially parallel to the longitudinal axis of the gun body;

a first retaining ring having a semicircular body about the longitudinal axis of the gun body and a first alignment tab substantially parallel to the longitudinal axis of the gun body; and a second retaining ring having a semicircular body about the longitudinal axis of the gun body and a second alignment tab substantially parallel to the longitudinal axis of the gun body;

wherein the first retaining ring is captured in the first retaining ring groove and prevents the charge holder from translating in the bore in at least a first direction and the first alignment tab engages with the first gun body alignment slot and the first charge holder alignment slot to prevent rotation of the charge holder within the bore; and wherein the second retaining ring is captured in the second retaining ring groove and prevents the charge holder from translating in the bore in at least a second direction and the second alignment tab engages with the second gun body alignment slot and the second charge holder alignment slot to prevent rotation of the charge holder within the bore.

6. The perforating gun of claim 5 wherein the engagement of the alignment tabs with the gun body alignment slots and charge holder alignment slots aligns the at least one charge hole with the at least one scallop.

7. The perforating gun of claim 6 further comprising:

a plurality of charge holes in the charge holder;

a plurality of scallops in the gun body;

wherein the engagement of the first and second alignment tabs with the gun body alignment slots and charge holder alignment slots aligns the charge holes with the scallops.

8. The perforating gun of claim 6 further comprising a grounding hole in the retaining rings.

* * * * *